US006454477B1

(12) United States Patent
Sugiyama

(10) Patent No.: US 6,454,477 B1
(45) Date of Patent: Sep. 24, 2002

(54) SHEET TRANSPORT DEVICE AND RECORDING APPARATUS

(75) Inventor: Noriyuki Sugiyama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 27 days.

(21) Appl. No.: 09/583,978

(22) Filed: May 31, 2000

(51) Int. Cl.[7] ..... B41J 13/03

(52) U.S. Cl. ..... 400/636.2; 400/636

(58) Field of Search ..... 400/636.2, 636, 400/625, 624; 347/4, 104

(56) References Cited

U.S. PATENT DOCUMENTS 5,523,848 A * 6/1996 Musso et al. ..... 358/296
5,725,206 A 3/1998 Sugiyama ..... 271/9.09
5,775,823 A 7/1998 Bekki et al. ..... 400/629
5,980,141 A * 11/1999 Donnis ..... 347/104
6,015,202 A * 1/2000 Hiramatsu et al. ..... 347/32
6,089,773 A * 7/2000 Bailey et al. ..... 400/642

* cited by examiner

*Primary Examiner*—Andrew H. Hirshfeld
*Assistant Examiner*—Anthony H. Nguyen
(74) *Attorney, Agent, or Firm*—Fitzpatrick, Cella, Harper & Scinto

(57) ABSTRACT

A sheet transport device and a recording apparatus include a transport roller constructed as a unit including a first gear and a protective member both integrally mounted on its rotary shaft, thereby ensuring easy handling, an inexpensive cost, good efficiency of assembly work, and high reliability. A transport roller gear (first gear) is provided at one end of the transport roller, and a substantially umbrella-shaped gear cover (protective member) is mounted to the outer side of the transport roller gear. The transport roller is constructed as a unit (transport roller unit) including the transport roller gear and the gear cover both integrally mounted on its rotary shaft. With this unitary structure, the transport roller can be easily handled, simply assembled into an apparatus body, and assembled with higher efficiency. The gear cover protects the least necessary gear(s), e.g., only the transport roller gear on the transport roller, and hence can be provided at an inexpensive cost.

31 Claims, 7 Drawing Sheets

SHEET TRANSPORT DEVICE AND RECORDING APPARATUS

BACKGROUND OF THE INVENTION

1. Field of the Invention

The present invention relates to a sheet transport device having a toothed wheel mounted on a rotary shaft of transport means for transporting a sheet. The sheet transport device is applied to a recording apparatus such as a printer, copying machine, word processor, personal computer, and facsimile, etc.

2. Description of the Related Art

In some conventional recording apparatuses, a transport roller is employed as transport means integrally provided with a rotary shaft for transporting a sheet, and a toothed wheel (referred to as a "gear" hereinafter) for transmitting torque to the transport roller is mounted on the transport roller. That type of recording apparatus has hitherto been constructed such that (1) no gear cover is provided for a gear on the transport roller, or (2) a gear cover is provided to protect the entirety the transmission gears for transmitting torque from a driving source to the transport roller, including the gear on the transport roller, as disclosed in Japanese Patent Laid-Open No. 5-289280.

In those recording apparatuses, because an effect of gear accuracy upon sheet transport accuracy cannot be moderated through a speed reduction, the gear mounted on the transport roller and serving as a final gear is designed to have a large diameter. Thus, the sheet transport accuracy is improved by setting the number of teeth of the gear mounted on the transport roller as large as possible.

However, the conventional recording apparatuses described above have the following problems:

(1) In the construction where no gear cover is provided for the gear on the transport roller, when the transport roller including the gear on the transport roller is assembled into a frame of an apparatus body, careful attention is required so that the gear on the transport roller will not contact surrounding parts and damage them. Accordingly, the efficiency in assembly work has been poor.

Further, even after the transport roller including the gear mounted thereon has been assembled into the frame, when the frame is assembled into an outer housing or when an upper case is mounted to the frame, careful attention is also required so that the outer housing or the upper case will not contact the gear on the transport roller and damage the same. Accordingly, the efficiency in assembly work has been poor in that point as well.

(2) In the construction where a gear cover is provided to protect the entirety of the transmission gears, a large space for the gear cover is required and the size of the apparatus is enlarged. Also, providing the gear cover necessarily pushes up a production cost.

Moreover, in any of the above cases (1) and (2), it has been difficult to move and store the transport roller as one unit that is in a condition where the gear is mounted on the transport roller. This difficulty has been inconvenient in handling the transport roller.

SUMMARY OF THE INVENTION

The present invention has been accomplished to solve the above-mentioned problems in the related art. An object of the present invention is to provide a sheet transport device and a recording apparatus in which transport means is constructed as a unit including a first gear and a protective member both integrally mounted on a rotary shaft, thereby ensuring easy handling, an inexpensive cost, good efficiency of assembly work and high reliability.

To achieve the above object, the present invention provides a sheet transport device comprising a transport roller having a rotary shaft rotatable about an axis and transporting a sheet with rotation of the rotary shaft, and a first gear fixedly coupled onto the rotary shaft of the transport roller and transmitting torque from a driving source to the rotary shaft, wherein the sheet transport device further comprises a protective member fixed to the rotary shaft and protecting teeth of the first gear.

With the above features, the transport roller can be constructed as a unit including the first gear and the protective member both integrally mounted on the rotary shaft (transport roller itself). In the unitized transport roller (transport roller unit), the teeth of the first gear are protected by the protective member. Therefore, the transport roller can be easily handled, simply assembled into an apparatus body, and assembled with higher efficiency. Further, the protective member protects only the first gear on the rotary shaft, and hence can be provided at an inexpensive cost.

Preferably, the first gear is fixed to one end of the rotary shaft, and the protective member is provided substantially in the form of an umbrella covering the first gear from the outer side of the one end of the rotary shaft.

With the above features, the protective member can protect the outer side of the one end of the rotary shaft, i.e., the first gear fixed to the one end and tending to be easily damaged.

Preferably, the protective member prevents the first gear from slipping off of the rotary shaft.

With the above feature, an additional part for preventing slip-off of the first gear is no longer required, an increase in the number of parts of the device can be avoided, and the device can be constructed at an inexpensive cost.

Preferably, the first gear includes a tubular fixing portion fixedly coupled to the rotary shaft, and the protective member has a fitting hole fitted to a tubular outer circumference of the tubular fixing portion, thereby positioning the protective member in a circumferential direction.

With the above features, since positioning of the protective member in the circumferential direction is made by fitting it between the tubular fixing portion and the fitting hole, the device size is not increased, and the device can be provided in a smaller space.

Preferably, a groove is formed in the tubular fixing portion of the first gear, a lug projecting radially inward is provided at an inner circumference of the fitting hole formed in the protective member, and the lug of the protective member is fitted in the groove of the tubular fixing portion to prevent the first gear from rotating relative to the transport roller.

With the above features, an additional part for preventing the first gear from rotating relative to the transport roller is no longer required, an increase in the number of parts of the device can be avoided, and the device can be constructed at an inexpensive cost.

Preferably, the protective member protects a second gear as well, which meshes with the first gear.

With the above feature, the teeth of the first gear can be protected with sufficient reliability. It is therefore easier to handle the transport roller which is constructed as a unit including the first gear and the protective member both integrally mounted on the rotary shaft.

A recording apparatus according to the present invention comprises the sheet transport device described above, and a recording unit for carrying out recording in accordance with image information on a sheet transported through the recording unit.

With the above features, since the transport roller can be easily handled in the form of a unit including the first gear and the protective member both integrally mounted on the rotary shaft, the efficiency of assembly work of the apparatus can be improved, a time required for the assembly work is cut down, and the apparatus can be manufactured at a relatively inexpensive cost.

Preferably, the recording unit is an ink jet recording unit.

DESCRIPTION OF THE PREFERRED EMBODIMENT

Preferred embodiments of the present invention will be described below in detail, by way of example, with reference to the drawings. It is to be noted that, as for the dimensions, materials, shapes and relative positions of components used in the embodiments, the scope of the present invention is not limited to the illustrated ones unless otherwise particularly specified.

First Embodiment

An ink jet recording apparatus, as an exemplary recording apparatus including the transport roller according to a first embodiment, will be described with reference to FIGS. 1 to 5. In these figures, like reference numbers indicate the same item.

Figure 1:
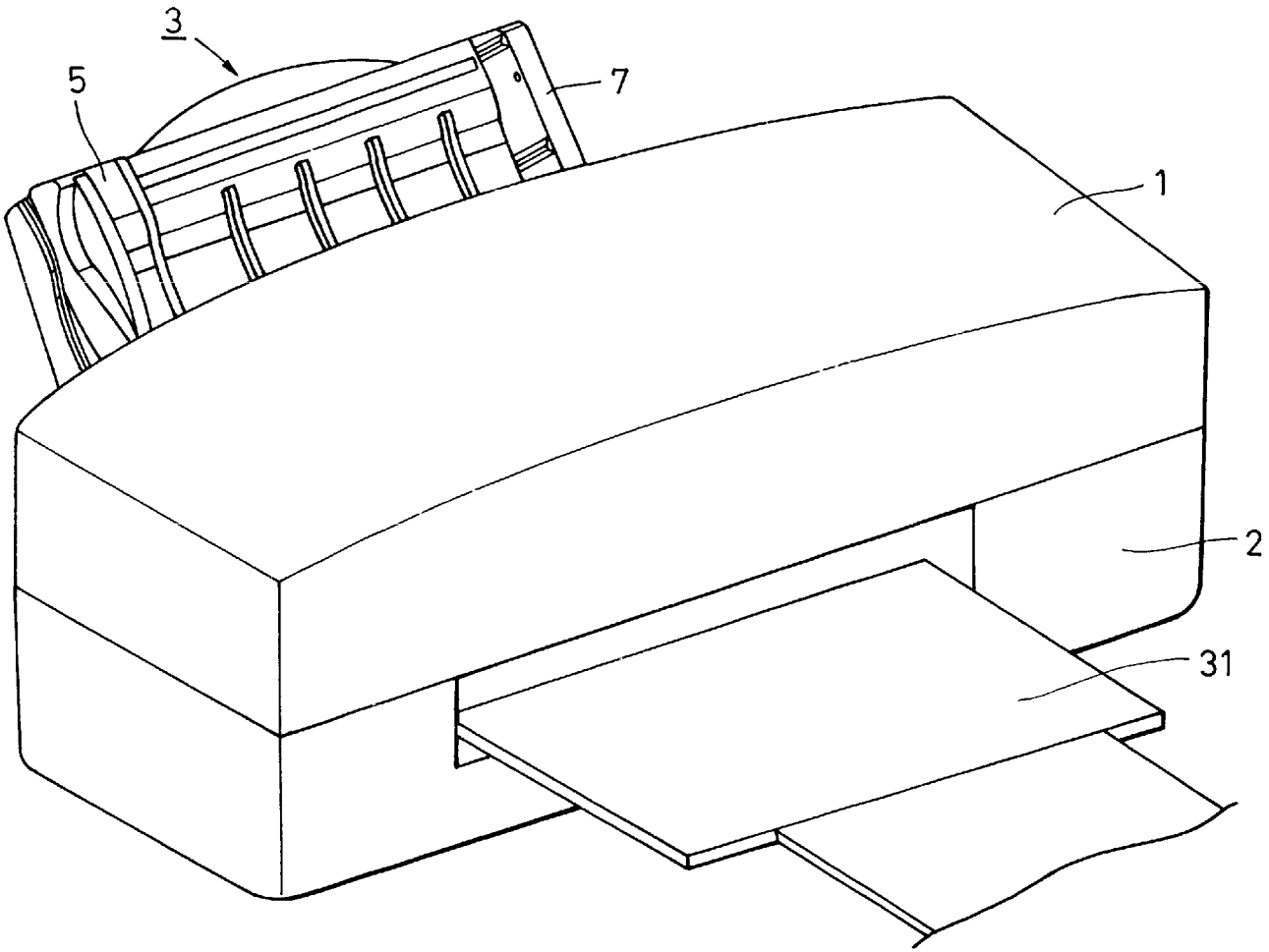
FIG. 1 is a perspective view showing an appearance of an ink jet recording apparatus according to a first embodiment.
Figure 2:
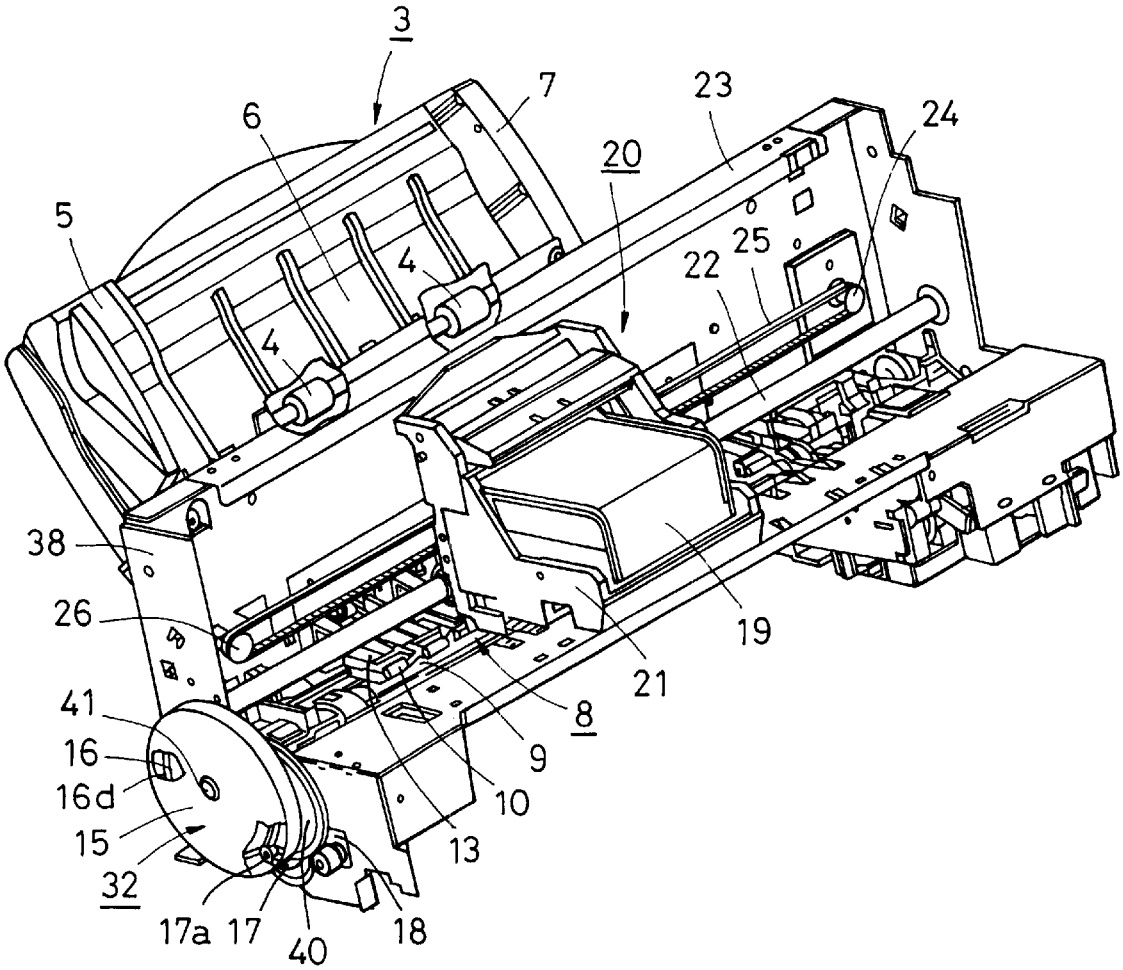
FIG. 2 is a perspective view showing a schematic internal construction of the ink jet recording apparatus according to the first embodiment.
Figure 3:
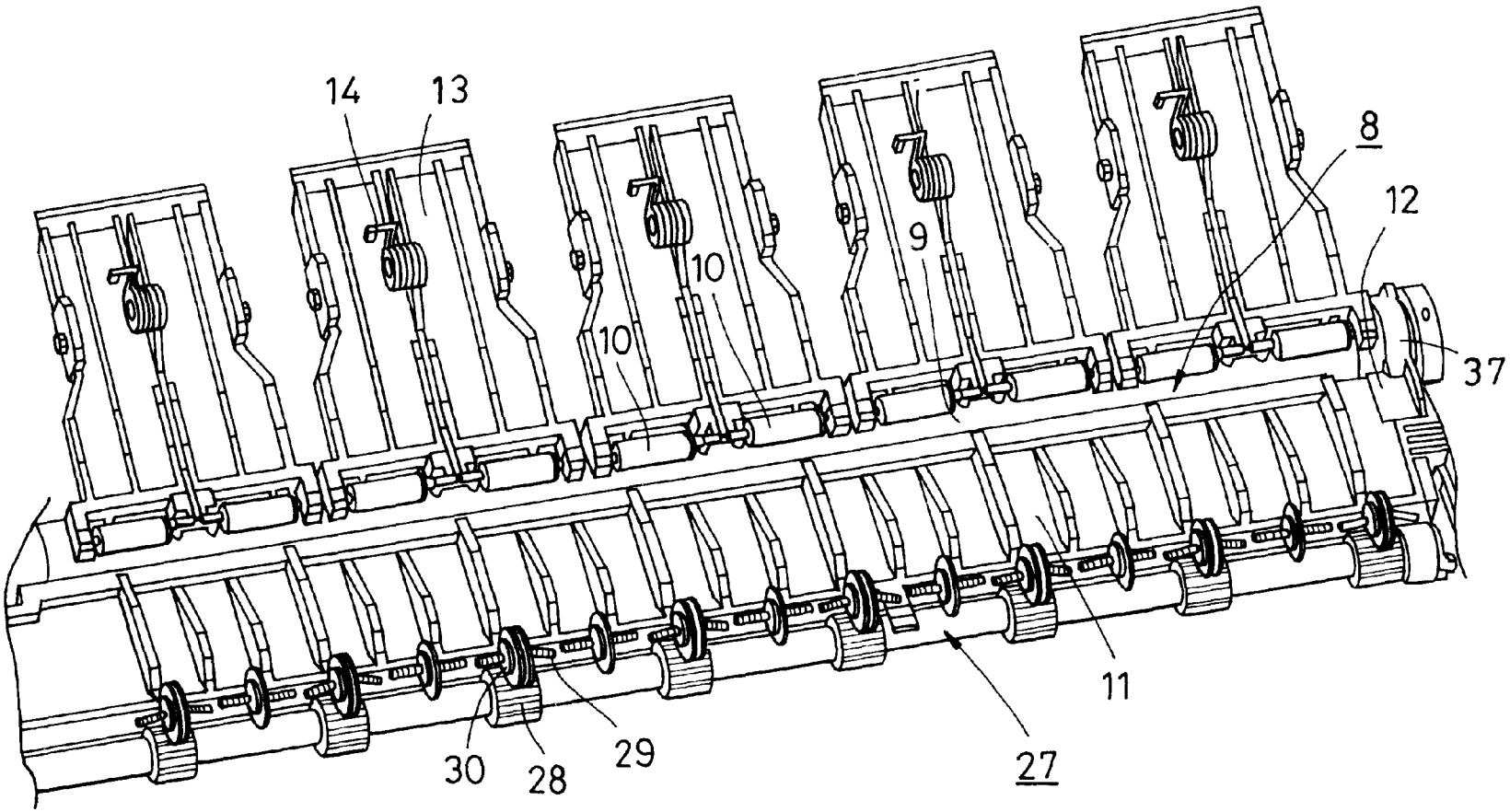
FIG. 3 is a perspective view showing a principal part around a recording section of the ink jet recording apparatus according to the first embodiment.
Figure 4:
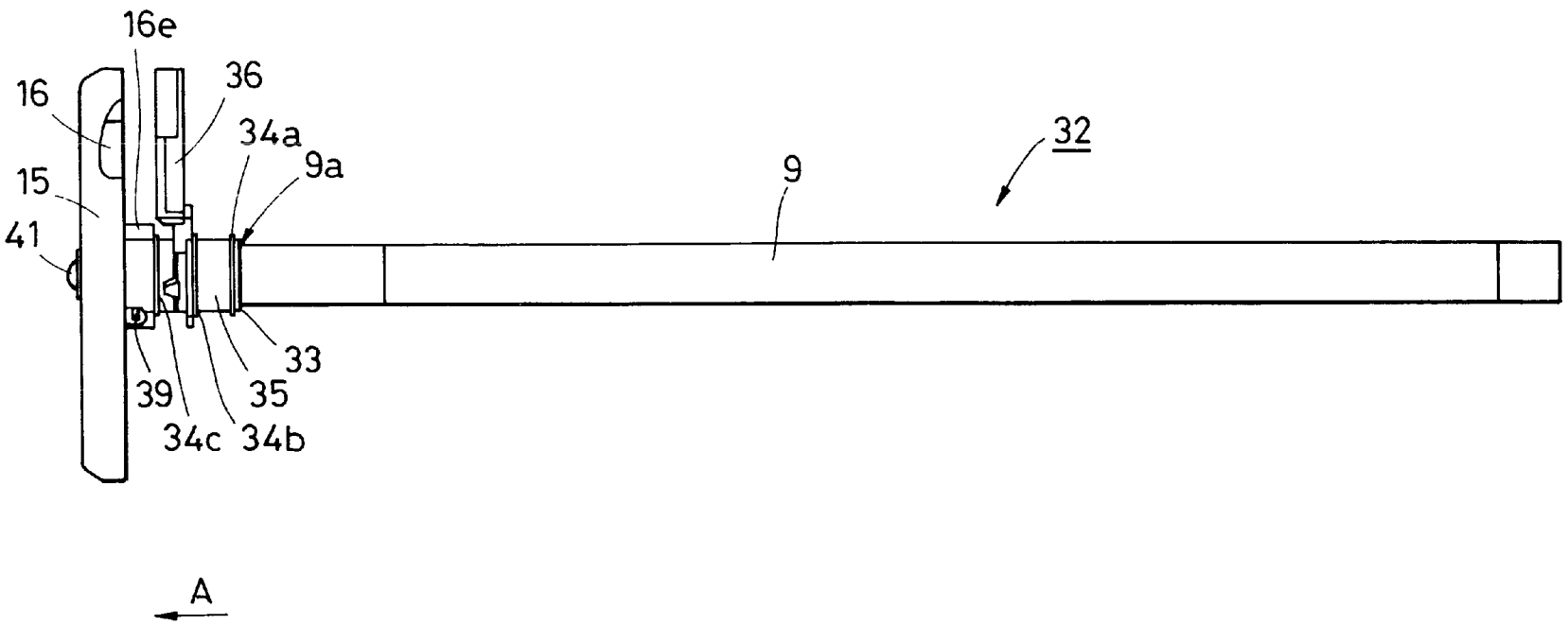
FIG. 4 is a front view of a transport roller unit according to the first embodiment.
Figure 5:
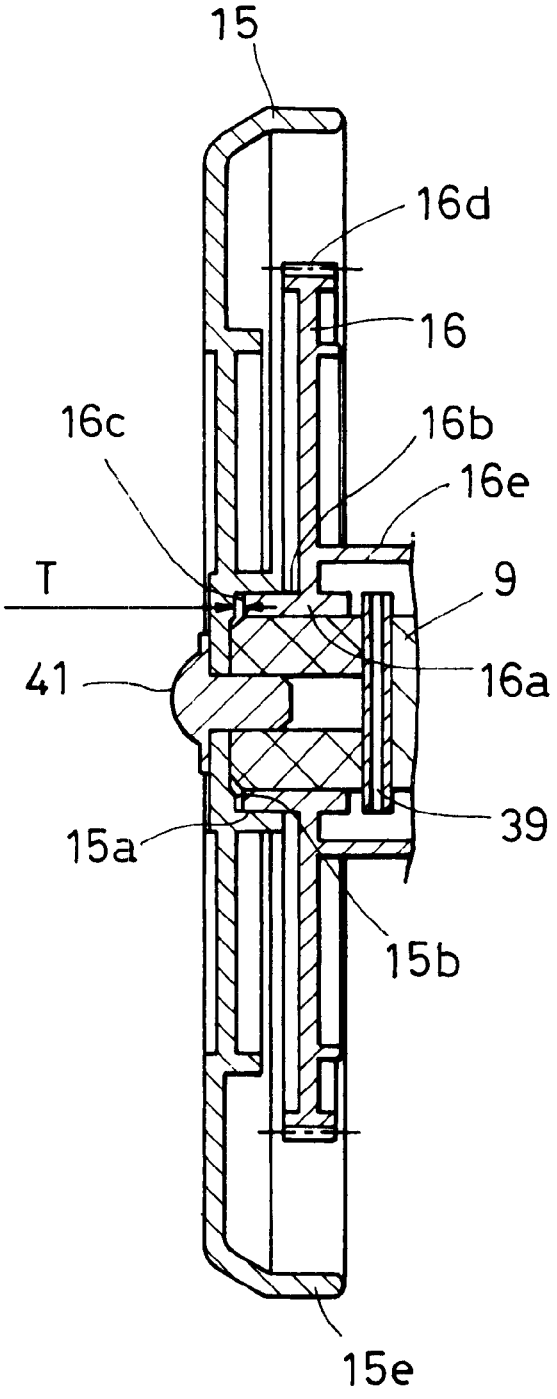
FIG. 5 is a partial sectional view of the transport roller unit shown in FIG. 4.

FIG. 1 is a perspective view showing an appearance of the ink jet recording apparatus. FIG. 2 is a perspective view showing a schematic internal construction of the ink jet recording apparatus. FIG. 3 is a perspective view showing a principal part around a recording section of the ink jet recording apparatus. FIG. 4 is a front view of a transport roller unit according to the first embodiment. FIG. 5 is a partial sectional view of the transport roller unit shown in FIG. 4.

First, the schematic construction of the ink jet recording apparatus will be described with reference to FIGS. 1 to 3. The ink jet recording apparatus of this embodiment includes a transport section 8, a recording section 20, and a paper ejecting section 27 which cooperatively constitute a sheet transport device, as well as a paper feed section 3. These sections are housed in an upper case 1 and a lower case 2. The constructions of the sections will be described below.

As shown in FIG. 1, the paper feed section 3 is attached to an apparatus body at an inclination angle of 30°~60°. Recording sheets set on the paper feed section 3 in a stacked state are each ejected horizontally from the apparatus body onto the paper ejection tray 31 after recording. Also, below the paper feed section 3, there is a paper feed opening (not shown) through which a recording sheet can be fed while it is held in a horizontal state.

As shown in FIG. 2, the paper feed section 3 includes paper feed rollers 4, a movable side guide 5, a pressure plate 6, a base 7, a separation claw (not shown), etc. Recording sheets stacked on the pressure plate 6 are fed to the transport section 8 one by one under cooperation of the separation claw and the paper feed rollers 4.

The transport section 8 includes a transport roller 9 integrally provided with a rotary shaft and serving as transport means, pinch rollers 10, a platen 11 (FIG. 3), a floating restriction member 12 (FIG. 3), etc. A recording sheet having been advanced from the paper feed section 3 to the transport section 8 is forwarded to nips between the transport roller 9 and the pinch rollers 10.

As shown in FIG. 3, the pinch rollers 10 are pressed against. the transport roller 9 by pinch roller springs 14 through pinch roller holders 13. The pinch rollers 10 are rotated following the rotation of the transport roller 9 to produce forces for advancing a recording sheet.

The transport roller 9 is rotated by a driving force of a drive motor 18. A transport roller gear 16 serving as a first gear is provided at one end of the transport roller 9, and a substantially umbrella-shaped gear cover 15 is mounted to the outer side of the transport roller gear 16.

The gear cover 15 includes, as shown in FIG. 5, a cylindrical peripheral wall 15*e* covering the transport roller gear 16. The gear cover 15 simultaneously protects both the transport roller gear 16 and a small gear portion 17*a* of an intermediate gear 17 which meshes with the transport roller gear 16 and serves as a second gear.

Thus, the transport roller 9 is constructed as a unit, i.e., a transport roller unit 32, including the transport roller gear 16 and the gear cover 15 both integrally mounted on its rotary shaft, i.e., on the transport roller 9 itself.

Then, the driving force of the drive motor 18 is transmitted to the transport roller 9 through the intermediate gear 17 and the transport roller gear 16. The recording sheet having been forwarded to the nips between the transport roller 9 and the pinch rollers 10 is transported through a predetermined amount on the platen 11 to a recording start position with the rotation of the transport roller 9.

The recording sheet having been transported through the predetermined amount is subjected to recording in accordance with predetermined image information by a recording head 19 serving as recording means. The recording head 19 records an ink image on the recording sheet that has been advanced under cooperation of the transport roller 9 and the pinch rollers 10. The recording means used in this embodiment is of the ink jet recording type ejecting ink from a recording head to carry out recording.

More specifically, the recording head includes fine liquid ejection ports (orifices), liquid passages, energy acting portions provided in respective parts of the liquid passages, and energy generating means for generating liquid droplet forming energy to act on liquids residing in the energy acting portions.

The energy generating means for generating such energy can be implemented in various forms corresponding to various recording methods. One recording method employs an electro-mechanical transducer such as a piezoelectric device. Another recording method employs an energy generating means, such as a laser, for irradiating an electromagnetic wave to generate heat so that liquid droplets are ejected under an action of the generated heat. Still another recording method employs an energy generating means for heating a liquid to eject the liquid with an electro-thermal transducer such as a heating element having a heating resistor.

Among those various forms, recording heads used in the ink jet recording method for ejecting a liquid with thermal energy are advantageous in that liquid ejection ports (orifices), through which the liquid is ejected to form liquid droplets for recording, can be arrayed with a higher density and hence recording can be achieved with a higher resolution. Among those recording heads, the recording head using an electro-thermal transducer as the energy generating means is advantageous. This type of head can be easily manufactured in more compact size, easily realized with high-density packaging, and produced at a relatively inexpensive cost, by fully utilizing the merits in the IC technology and micromachining technology, which have been recently remarkably developed and improved in reliability in the field of semiconductors.

The recording section 20 includes, as shown in FIG. 2, a carriage 21 to which the recording head 19 is attached; a guide shaft 22 along which the carriage 21 is reciprocally scanned in a direction perpendicular to the direction of sheet transport; a guide 23 for holding a top portion of the carriage 21 to maintain a distance between the recording head 19 and a recording sheet; a timing belt 25 for transmitting the torque of a carriage motor 24 to the carriage 21; an idle pulley 26 for stretching the timing belt 25 between itself and the carriage motor 24; a flexible board (not shown) for transmitting a head driving signal to the recording head 19 from an electric circuit board, and so on.

Then, the recording head 19 is scanned together with the carriage 21 to record an ink image on the recording sheet standing by in the recording start position.

Thereafter, each time the recording sheet is advanced 5.42 mm, for example, in units of a line with the rotation of the transport roller 9, the recording head 19 is scanned together with the carriage 21 to successively record an ink image on the recording sheet lying over the platen 11.

As shown in FIGS. 2 and 3, the paper ejection section 27 includes a paper ejection roller 28; a paper ejection roller gear 40 fitted over the paper ejection roller 28 and transmitting the driving force of the drive motor 18 to the paper ejection roller 28 through the intermediate gear 17; spurs 30 pressed against the paper ejection roller 28 by urging forces of spring shafts 29, which are attached to spur holders (not shown), and rotated following the rotation of the paper ejection roller 28, which thereby generate forces to advance the recording sheet; a paper ejection tray 31 for assisting the ejection of the recording sheet.

Next, the transport roller unit 32 will be described with reference to FIGS. 4 and 5. The transport roller unit 32 shown in FIG. 4 is constructed such that a CE ring 33 is fitted in a groove 9*a* formed in the transport roller 9, and a compression spring 35 is fitted next to a washer 34*a* on the side of the CE ring 33 nearer to the transport roller gear 16. A restoring force of the compression spring 35 urges the transport roller 9 so as to eliminate a play in the thrust direction thereof.

A left-hand bearing 36 is fitted next to a washer 34*b* on the side of the compression spring 35 nearer to the transport roller gear 16. The left-hand bearing 36 is mounted to a frame 38 (FIG. 2) along with a right-hand bearing 37 (FIG. 3) in a transversely spaced relation, whereby the transport roller 9 is rotatably fitted to the frame 38.

The transport roller gear 16 is press-fitted next to a washer 34*c* on the side adjacent to the left-hand bearing 36. Free rotation of the transport roller gear 16 relative to the transport roller 9 is checked by a spring pin 39 that is inserted in a through hole of the transport roller 9 in an engagement relation to the inner peripheral side of a tubular portion 16*e* of the transport roller gear 16.

As shown in FIG. 5, the transport roller gear 16 has a positioning insert portion 16*a* that is a tubular fixing portion to fixedly couple the transport roller gear 16 to the transport roller 9. Then, circumferential positioning of the gear cover 15 is effected by fitting a circumferential positioning portion 15*a* of the gear cover 15, which is defined by an inner circumference of a fitting hole formed in the gear cover 15, with an outer circumferential portion 16*b* of the transport roller gear 16, which is defined by a tubular outer circumference of the positioning insert portion 16*a* thereof.

The gear cover 15 is fixed by a screw 41 to an outer end surface of one end of the transport roller 9 to which the transport roller gear 16 is fixedly coupled. The gear cover 15 is therefore rotated in union with the transport roller 9 and the transport roller gear 16.

Further, a clearance T between a slip-off preventing surface 15*b* of the gear cover 15, which serves to prevent the transport roller gear 16 from slipping off, and an end surface 16*c* of the positioning insert portion 16*a* of the transport roller gear 16 is set to approximately 0.3 mm.

Therefore, when the transport roller gear 16 is moved in a direction A in FIG. 4 by the restoring force of the compression spring 35, the end surface 16*c* of the transport roller gear 16 abuts against the slip-off preventing surface 15*b* of the gear cover 15, whereby the transport roller gear 16 is prevented from slipping off of the transport roller 9.

Further, as shown in FIG. 2, the gear cover 15 covers the small gear portion 17*a* of the intermediate gear 17 as well, which meshes with the transport roller gear 16. Simultaneously, a gear tooth face 16*d* of the transport roller gear 16 is covered and protected by the gear cover 15.

With this embodiment, as described above, since the. transport roller 9 is constructed as a unit including the transport roller gear 16 and the gear cover 15 both integrally mounted on the transport roller 9, there is no fear of damaging the gear tooth face 16*d* even when the transport roller 9 is left or moved in the form of the transport roller unit 32. This results in an advantage of improving the efficiency in handling the transport roller 9.

Also, the work of assembling the transport roller 9 including the gear cover 15 mounted thereon into the frame 38, or the work of assembling the transport roller 9 including the gear cover 15 mounted thereon into the lower case 2 or the upper case 1 can be implemented in the form of the transport roller unit 32 with no fear of damaging the transport roller gear 16. This results in an advantage of facilitating the efficiency of the assembly work.

Further, since the gear cover 15 simultaneously covers not only the transport roller gear 16 having a large diameter and tending to easily suffer damage, but also the small gear portion 17*a* of the intermediate gear 17 which meshes with the transport roller gear 16, the gear tooth face 16*d* of the transport roller gear 16 can be protected with certainty. This results in an advantage of further improving the efficiency in handling the transport roller 9.

Still further, since the gear cover 15 protects only the least necessary gears, advantages are obtained in suppressing an increase in size of the recording apparatus, reducing a space occupied by the same, and improving the efficiency of assembly work with an inexpensive construction.

Moreover, since the gear cover 15 serves also to prevent the transport roller gear 16 from slipping off, advantages are obtained in needing an additional slip-off preventing member, and providing a more inexpensive construction with the reduced number of parts.

In this embodiment, the transport roller gear 16 is protected by the gear cover 15 provided so as to extend to a position completely covering the gear tooth face 16*d* of the transport roller gear 16 when viewed in the circumferential direction of the transport roller 9. However, a protection effect can be obtained in various degrees depending on how far the tooth width of the transport roller gear 16 is covered by the gear cover 15.

Also, it is a matter of course that the clearance T between the slip-off preventing surface 15*b* of the gear cover 15, which serves to prevent the transport roller gear 16 from slipping off, and the end surface 16*c* of the positioning insert portion 16*a* of the transport roller gear 16 may be set freely other than 0.3 within such a range that the gear cover 15 can be fitted over the transport roller 9 and the transport roller gear 16 is allowed to move.

Further, while this embodiment has been described in connection with an ink jet recording apparatus provided with the recording head 19 as the recording means, the present invention is also applicable to any other apparatus of a construction. including the transport roller unit 32, for example, a recording apparatus that employs an electro photographic recording means and records an image on a recording sheet with toner, or an image reading apparatus for reading an original document in the form of a sheet.

Second Embodiment

Figure 6:
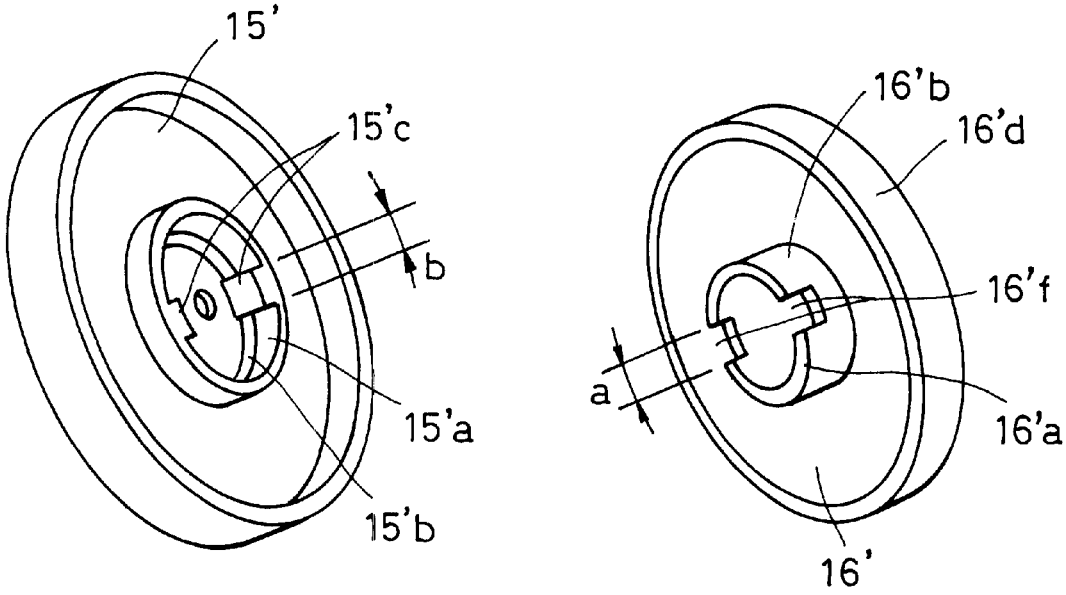
FIG. 6 is a perspective view showing a transport roller gear and a gear cover according to a second embodiment.

FIG. 6 is a perspective view showing a transport roller gear and a gear cover according to a second embodiment. A description is made here of only the circumferential positioning between the transport roller gear and the gear cover. The remaining construction and the operation are the same as those in the first embodiment, and therefore are not described here. Also, items 15'*b* and 16'*d* correspond to items 15*b* and 16*d* of the first embodiment.

In this embodiment, as shown in FIG. 6, a positioning insert portion 16'*a* of a transport roller gear 16', which is fitted over the transport roller 9, is partly cut out to form grooves 16'*f*. Also, positioning portions 15'*c* in the form of lugs are provided on a gear cover 15' so as to project radially inward and abut against an outer circumference of the transport roller 9.

Then, the positioning portions 15'*c* of the gear cover 15' are fitted into the grooves 16'*f* of the transport roller gear 16', whereby the gear cover 15' is positioned in the circumferential direction by the outer circumference of the transport roller 9.

Additionally, a clearance may be left between a circumferential positioning portion 15'*a* of the gear cover 15' and an outer circumferential portion 16'*b* of the transport roller gear 16.

In this connection, by setting a width a of each groove 16'*f* of the transport roller gear 16' to be coincident with a width b of each positioning portion 15'*c* of the gear cover 15', free rotation of the transport roller gear 16' relative to the transport roller 9 can be prevented. This results in an advantage that the spring pin 39 for checking free rotation of the transport roller gear 16' is no longer required and a more inexpensive apparatus can be realized with the reduced number of parts.

Instead of employing the groove 16'*f* formed by cutting out a part of the positioning insert portion 16'*a* like this embodiment, the circumferential positioning of the gear cover 15' may be effected by extending the transport roller 9 to be slightly longer so as to project outward of the end surface 16*c* of the positioning insert portion 16*a* of the transport roller gear 16 in the first embodiment (see FIG. 5), and by positioning the circumferential positioning portion 15'*a* of the gear cover 15' onto the outer circumference of the projected portion of the transport roller 9. This modification can also provide a similar advantage as with the second embodiment although a somewhat larger space is needed in the axial direction of the transport roller 9.

Third Embodiment

Figure 7:
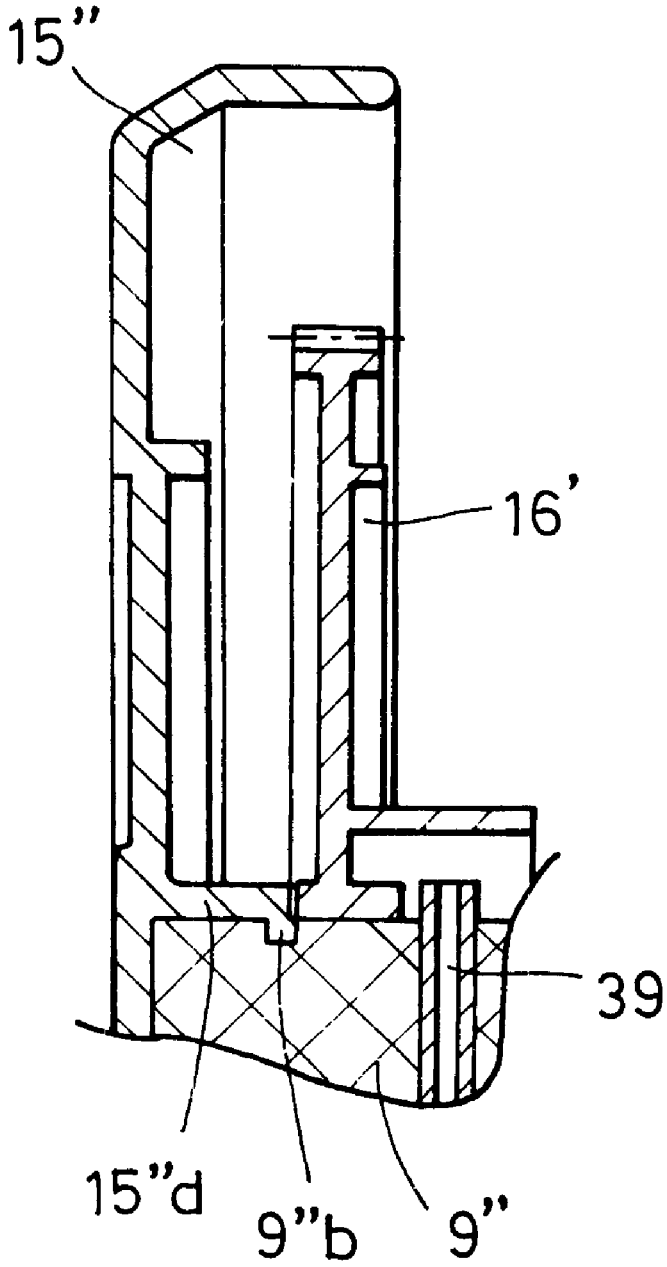
FIG. 7 is a partial sectional view showing a transport roller and a gear cover according to a third embodiment.

FIG. 7 is a partial sectional view showing a transport roller and a gear cover according to a third embodiment. A description is made here of only the fixing of the gear cover to the transport roller. The remaining construction and the operation are the same as those in the first embodiment, and therefore are not described here.

In the above first embodiment, the gear cover 15 has been described as being fixed to the transport roller 9 by a screw. As a matter of course, however, a manner of fixedly attaching the gear cover 15 to the transport roller 9 is not limited to the use of a screw.

In this third embodiment, as shown in FIG. 7, a finger 15"*d* is provided on a gear cover 15", and a claw-like end of the finger 15"*d* is engaged in a groove 9"*b* formed in the transport roller 9". This embodiment can also provide a similar advantage as with the first embodiment.

Thus, the manner of fixedly attaching the gear cover 15 in place is not particularly limited, but can be implemented using any suitable well-known manner.

In the above embodiments, the gear cover has a peripheral wall covering tooth crests of both a first gear and a second gear. However, the gear cover is not limited to such a construction, but may be constructed to protect the tooth crests with wires, a net or the like.

Also, while in the above embodiments the gear cover 15 is mounted to the rotary shaft of the transport roller, the gear cover 15 may be mounted to the first gear.

According to the sheet transport device of the present invention, as described above, since the device includes a protective member fixed to a rotary shaft of transport means and protecting teeth of a first gear, the transport means can be constructed as a unit including the first gear and the protective member both integrally mounted on the rotary shaft. In the unitized transport means (transport roller unit), the teeth of the first gear are protected by the protective member. Therefore, the transport means can be easily handled, simply assembled into an apparatus body, and assembled with higher efficiency. Further, the protective member protects only the first gear on the rotary shaft, and hence can be provided at an inexpensive cost.

With such an arrangement that the first gear is fixed to one end of the rotary shaft and the protective member is provided substantially in the form of an umbrella covering the first gear from the outer side of the one end of the rotary shaft, the protective member can protect the outer side of the one end of the rotary shaft, i.e., the first gear fixed to the one end and tending to be easily damaged.

Since the protective member prevents the first gear from slipping off of the rotary shaft, an additional part for preventing slip-off of the first gear is no longer required, an increase in the number of parts of the device can be avoided, and the device can be constructed at an inexpensive cost.

With such an arrangement that the first gear includes a tubular fixing portion fixedly coupled to the rotary shaft and the protective member has a fitting hole fitted to a tubular outer circumference of the tubular fixing portion, thereby positioning the protective member in a circumferential direction, positioning of the protective member in the circumferential direction is made by fitting between the tubular fixing portion and the fitting hole, the device size is not increased and the device can be provided in a smaller space.

With such an arrangement that a groove is formed in the tubular fixing portion of the first gear, a lug projecting radially inward is provided at an inner circumference of the fitting hole formed in the protective member, and the lug of the protective member is fitted in the groove of the tubular fixing portion to prevent the first gear from rotating relative to the transport roller, an additional part for preventing the first gear from rotating relative to the transport means is no longer required, an increase in the number of parts of the device can be avoided, and the device can be constructed at an inexpensive cost.

Since the protective member protects a second gear as well, which meshes with the first gear, the teeth of the first gear can be protected with sufficient reliability. It is therefore easier to handle the transport means which is constructed as a unit including the first gear and the protective member both integrally mounted on the rotary shaft.

Since a recording apparatus according to the present invention comprises the sheet transport device described above and recording means for carrying out recording in accordance with image information on a sheet transported through the recording means, the transport means can be easily handled in the form of a unit including the first gear and the protective member both integrally mounted on the rotary shaft. As a result, the efficiency of assembly work of the apparatus can be improved, a time required for the assembly work is cut down, and the apparatus can be manufactured at a relatively inexpensive cost.

What is claimed is:

1. A sheet transport device comprising:

a transport roller unit having a rotary shaft rotatable about an axis for transporting a sheet with rotation of said rotary shaft;

a driving source;

a first gear having teeth, said first gear being fixedly coupled onto said rotary shaft of said transport roller unit and transmitting torque from a driving source to said rotary shaft; and an umbrella shaped protective member fixed to said rotary shaft of said transport roller unit and having a cylindrical peripheral wall inside an outer perimeter of said protective member and extending in a direction parallel to said rotary shaft to protect the teeth of said first gear.

2. A sheet transport device according to claim 1, wherein said first gear is fixedly coupled to one end of said rotary shaft.

3. A sheet transport device according to claim 1 or 2, wherein said protective member prevents said first gear from slipping off of said rotary shaft.

4. A sheet transport device according to claim 3, wherein said first gear includes a tubular fixing portion fixedly coupled to said rotary shaft, and wherein said protective member has a circumferential fixing portion fitted to a tubular outer circumference of said tubular fixing portion of said first gear, thereby positioning said protective member in a circumferential direction.

5. A sheet transport device according to claim 4, wherein a groove is formed in said tubular fixing portion of said first gear, wherein a lug projecting radially inward is provided at an inner circumference of said circumferential fitting portion formed in said protective member, and wherein the lug of said protective member is fitted into the groove of said tubular fixing portion to prevent said first gear from rotating relative to said transport roller unit.

6. A sheet transport device according to claim 5, further comprising a second gear meshing with said first gear, wherein said protective member also protects said second gear.

7. A recording apparatus comprising:

a sheet transport device according to any one of claims 1 or 2 and recording means for recording an image, in accordance with image information, on a sheet transported through said recording means.

8. A recording apparatus according to claim 7, wherein said recording means is ink jet recording means.

9. A sheet transport device, comprising:

a roller for transporting a sheet and having a rotary shaft;

a driving source;

a first gear fixed to said rotary shaft of said roller and receiving torque from said driving source; and an umbrella shaped protective member mounted to one of said rotary shaft and said first gear and having a cylindrical peripheral wall inside an outer perimeter of said protective member and extending in a direction parallel to said rotary shaft to protect teeth of said first gear.

10. A sheet transport device according to claim 9, wherein said protective member has a peripheral wall covering an outer periphery of said first gear.

11. A sheet transport device according to claim 9, further comprising a second gear meshing with said first gear, wherein said protective member also covers said second gear.

12. A sheet transport device according to claim 11, wherein said second gear transmits the torque from said driving source to said first gear.

13. A sheet transport device according to claim 11, wherein the peripheral wall covers both outer peripheries of said first gear and said second gear.

14. A method of assembling a sheet transport device, comprising the steps of:

assembling a unit comprising, a roller, having a rotary shaft, for transporting a sheet, a driving source;

a first gear having teeth and fixed to the rotary shaft of the roller and receiving torque from the driving source, and an umbrella shaped protective member mounted to one of said rotary shaft and said first gear and having a cylindrical peripheral wall inside an outer perimeter of said protective member and extending in a direction parallel to said rotary shaft to protect the teeth of the first gear; and attaching the unit to a body of the sheet transport device.

15. A method of assembling a sheet transport device according to claim 14, wherein the assembly unit further comprises a second gear meshing with the first gear and when the unit is attached in said attaching step to the body of the sheet transport device, the protective member also covers the second gear.

16. A recording apparatus comprising:

a sheet transport device according to any one of claims 9 to 13; and recording means for recording an image, in accordance with image information, on a sheet transported through said recording means.

17. A recording apparatus according to claim 16, wherein said recording means includes an ink jet recording head.

18. A sheet transport device, comprising:

a transport roller unit, having a rotary shaft rotatable about an axis, for transporting a sheet with rotation of said rotary shaft; and a driving source;

a first gear having teeth and fixedly coupled onto said rotary shaft of said transport roller unit and transmitting torque from the driving source to said rotary shaft; and an umbrella shaped protective member rotated in union with said first gear and having a cylindrical peripheral wall inside an outer perimeter of said protective member and extending in a direction parallel to said rotary shaft and protective said teeth of said first gear.

19. A sheet transport device according to claim 18, wherein said protective member is fixed to said rotary shaft.

20. A sheet transport device according to claim 18 or 19, wherein said protective member protects said teeth of said first gear in a condition in which said transport roller unit, said first gear, and said protective member are constructed as a unit.

21. A sheet transport device according to claim 18 or 19, wherein said first gear is fixed to one end of said rotary shaft.

22. A sheet transport device according to claim 18 or 19, wherein said protective member prevents said first gear from slipping off of said rotary shaft.

23. A sheet transport device according to claim 19, wherein said first gear includes a tubular fixing portion fixedly coupled to said rotary shaft, and wherein said protective member has a circumferential fitting portion fitted to a tubular outer circumference of said tubular fixing portion, thereby positioning said protective member in a circumferential direction.

24. A sheet transport device according to claim 20, wherein said first gear includes a tubular fixing portion fixedly coupled to said rotary shaft, and wherein said protective member has a circumferential fitting portion fitted to a tubular outer circumference of said tubular fixing portion, thereby positioning said protective member in a circumferential direction.

25. A sheet transport device according to claim 19, wherein a groove is formed in said tubular fixing portion of said first gear, wherein a lug projecting radially inward is provided at an inner circumference of said circumferential fitting portion formed in said protective member, and wherein the lug of said protective member is fitted into the groove of said tubular fixing portion to prevent said first gear from rotating relative to said rotary shaft.

26. A sheet transport device according to claim 20, wherein a groove is formed in said tubular fixing portion of said first gear, wherein a lug projecting radially inward is provided at an inner circumference of said circumferential fitting portion formed in said protective member, and wherein the lug of said protective member is fitted into the groove of said tubular fixing portion to prevent said first gear from rotating relative to said rotary shaft.

27. A sheet transport device according to claim 19, further comprising a second gear meshing with said first gear, wherein said protective member also protects said second gear.

28. A sheet transport device according to claim 20, further comprising a second gear meshing with said first gear, wherein said protective member also protects said second gear.

29. A recording apparatus comprising:

a sheet transport device according to claim 19; and recording means for recording an image, in accordance with image information, on a sheet transported through said recording means.

30. A recording apparatus comprising:

a sheet transport device according to claim 20; and recording means for recording an image, in accordance with image information, on a sheet transported through said recording means.

31. A recording apparatus according to claim 30, wherein said recording means includes an ink jet recording head.

* * * * *

UNITED STATES PATENT AND TRADEMARK OFFICE

CERTIFICATE OF CORRECTION

PATENT NO. : 6,454,477 B1
DATED : September 24, 2002
INVENTOR(S) : Noriyuki Sugiyama It is certified that error appears in the above-identified patent and that said Letters Patent is hereby corrected as shown below:

Title page,
Insert: -- [30] Foreign Application Priority Data
Jun. 2, 1999 (JP) ……. 11-155025 --.

Column 10,
Line 25, "or 2" should read -- or 2, --.

Signed and Sealed this

Twenty-fifth Day of February, 2003

JAMES E. ROGAN
*Director of the United States Patent and Trademark Office*